US009115940B2

(12) United States Patent
Mackin

(10) Patent No.: US 9,115,940 B2
(45) Date of Patent: Aug. 25, 2015

(54) DEFROSTABLE HEAT EXCHANGING APPARATUS AND ASSOCIATED METHOD

(75) Inventor: Steven George Mackin, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 323 days.

(21) Appl. No.: 13/204,414

(22) Filed: Aug. 5, 2011

(65) Prior Publication Data

US 2013/0031917 A1 Feb. 7, 2013

(51) Int. Cl.

| | |
|---|---|
| ***F28F 17/00*** | (2006.01) |
| ***F28F 19/00*** | (2006.01) |
| ***F28F 27/02*** | (2006.01) |

(52) U.S. Cl.

CPC ..... *F28F 17/00* (2013.01); *F28F 19/006* (2013.01); *F28F 27/02* (2013.01)

(58) Field of Classification Search

CPC ..... F28F 17/00; F28F 19/006; F28F 27/02
USPC ..... 62/80, 81, 272, 278; 165/96, 101, 103
See application file for complete search history.

(56) References Cited

U.S. PATENT DOCUMENTS

| | | | | |
|---|---|---|---|---|
| 2,465,259 | A * | 3/1949 | Nelson | 116/22 A |
| 4,040,478 | A | 8/1977 | Pogson et al. | |
| 4,244,422 | A * | 1/1981 | Hallgren | 165/101 |
| 4,748,823 | A * | 6/1988 | Asano et al. | 62/239 |
| 5,323,626 | A * | 6/1994 | Gazzarrini et al. | 66/149 S |
| 6,564,796 | B1 | 5/2003 | Guy | |
| 7,775,817 | B2 | 8/2010 | Cain et al. | |
| 7,837,149 | B2 | 11/2010 | Mackin | |
| 8,265,805 | B2 | 9/2012 | Ma et al. | |
| 8,973,393 | B2 | 3/2015 | Atkey et al. | |
| 2006/0090879 | A1 * | 5/2006 | Han | 165/96 |
| 2007/0227160 | A1 | 10/2007 | Johnson | |
| 2008/0099191 | A1 * | 5/2008 | Taras et al. | 165/174 |
| 2008/0314560 | A1 | 12/2008 | Grayson et al. | |
| 2009/0125167 | A1 | 5/2009 | Ma et al. | |
| 2010/0244343 | A1 | 9/2010 | Hull et al. | |
| 2011/0107777 | A1 | 5/2011 | Atkey et al. | |
| 2012/0291459 | A1 | 11/2012 | Millar et al. | |

* cited by examiner

*Primary Examiner* — Judy Swann
*Assistant Examiner* — Zachary R Anderegg
(74) *Attorney, Agent, or Firm* — Alston & Bird LLP

(57) ABSTRACT

A heat exchanging apparatus and an associated method are provided so as to permit a heat exchanger to be defrosted without being taken out of service. A defrostable heat exchanging apparatus includes a heat exchanger configured to cool gas flowing there through by heating a liquid also passing there through. The defrostable heat exchanging apparatus also includes a blockage positionable upstream of the heat exchanger with respect to the liquid so as to reduce flow of the liquid through a portion of the heat exchanger aligned with the blockage relative to the flow of the liquid through other portions of the heat exchanger. The defrostable heat exchanging apparatus may also include a positioning mechanism for moving the blockage relative to the heat exchanger.

19 Claims, 5 Drawing Sheets

DEFROSTABLE HEAT EXCHANGING APPARATUS AND ASSOCIATED METHOD

TECHNOLOGICAL FIELD

Embodiments of the present disclosure relate generally to heat exchangers and, more particularly, to defrostable heat exchangers and associated methods.

BACKGROUND

Liquid to air heat exchangers transfer heat between a liquid and air or another gas. For example, a heat exchanger may be configured to cool relatively warm air. As such, the heat exchanger may receive warm air along with a cool liquid. Heat from the air may be absorbed by the liquid so as to cool the air and heat the liquid. As such, cooler air may exit from the heat exchanger along with a warmer liquid following the heat exchange therebetween.

In order to exchange heat between an air and a liquid, a heat exchanger may include a plurality of first channels through which the liquid passes and a plurality of second channels through which the air flows. These channels may be mutually exclusive, but may be arranged and constructed so as to facilitate heat exchange between the air and the liquid passing through the respective channels. In this regard, the first and second channels through which the liquid and air flow, respectively, may be positioned in an alternating fashion such that a common wall separates a channel through which liquid passes from a channel through which air flows, thereby facilitating heat exchange between the liquid and the air. Additionally, the heat exchanger may include fins, such as fins extending from the walls that define the respective channels into, for example, the channels through which the air flows in order to facilitate heat exchange therebetween.

In some instances, the liquid that is provided to the heat exchanger has a temperature lower than the freezing temperature of water in order to provide for more effective heat transfer. In this instance, liquid that condenses from the warm, humid air that is received by the heat exchanger for cooling may freeze within the heat exchanger. Over the course of time, the build up of ice within the heat exchanger will limit the cooling capacity of the heat exchanger by limiting the amount of air that may flow through the heat exchanger. Eventually, sufficient amounts of ice may form within the heat exchanger so as to prevent air from flowing through the heat exchanger, thereby eliminating further heat exchange.

In order to avoid the limitations upon the cooling capacity occasioned by freezing within the heat exchanger, the system may be designed such that the liquid provided to the heat exchanger has a temperature above the freezing temperature of water. For example, the heat exchanger may be positioned at the end of a cooling circuit so that the liquid provided to the heat exchanger is above the freezing temperature of water. However, this technique generally requires additional plumbing and more complex controls and sensors, thereby disadvantageously increasing the weight of the system. In instances in which the heat exchanger is employed in weight-sensitive application, such as applications carried vehicles, such as air vehicles, the increase in weight may, in turn, disadvantageously affect the performance of the vehicle. Additionally, the cooling capacity of the heat exchanger is disadvantageously limited by requiring the liquid to remain above the freezing temperature of water. Further, the use of liquid having a temperature above the freezing temperature of water will generally disadvantageously increase the air temperature at the exit of the heat exchanger, thereby potentially decreasing overall system performance.

Alternatively, the heat exchanger may be periodically taken out of service and defrosted. In this regard, the heat exchanger may be taken out of service by halting the flow of cool liquid to the heat exchanger. By continuing to provide warm air to the heat exchanger, the heat exchanger may be defrosted. By taking the heat exchanger out of service, however, the heat exchanger is unable to perform its function, thereby reducing quantity of air that is cooled and preventing continuous operation.

BRIEF SUMMARY

A heat exchanging apparatus and an associated method are provided so as to permit a heat exchanger to be defrosted without being taken out of service. As such, a heat exchanger may continue to exchange heat between a gas and a liquid that flow through the heat exchanger while the heat exchanger is being defrosted. Thus, the heat exchanging apparatus and associated method may reduce icing within a heat exchanger while permitting the heat exchanger to continue to function. Additionally, the heat exchanging apparatus and method of one embodiment permits the cool liquid to be provided at a temperature below the freezing temperature of water in order to improve the cooling efficiency of the system since any ice build up may be readily defrosted.

In one embodiment, a defrostable heat exchanging apparatus is provided that includes a heat exchanger configured to cool gas flowing therethrough by heating a liquid also passing therethrough. The defrostable heat exchanging apparatus of this embodiment also includes a blockage positionable upstream of the heat exchanger with respect to the liquid so as to reduce flow of the liquid through a portion of the heat exchanger aligned with the blockage relative to the flow of the liquid through other portions of the heat exchanger. The heat exchanger may be configured such that the liquid flows from a first side to a second side of the heat exchanger with the blockage being smaller than the first side of the heat exchanger so as to only block a portion of the heat exchanger. Further, the defrostable heat exchanging apparatus may include a positioning mechanism for moving the blockage relative to the heat exchanger.

The positioning mechanism may be configured to be actuated by the flow of liquid so as to move the blockage relative to the heat exchanger. In this regard, the positioning mechanism may include a chain and a plurality of sprockets about which the chain extends with the blockage being engaged by the chain so as to move therewith. The positioning mechanism may also include at least one of a Pelton wheel or a water wheel operably connected to a respective sprocket. In this embodiment, the defrostable heat exchanging apparatus may also include a control valve configured to control the flow of liquid to the at least one of the Pelton wheel or the water wheel in order to controllably move the chain and position the blockage. The blockage may be positionable outside of the flow of the liquid through the heat exchanger. As such, the defrostable heat exchanging apparatus may include a blockage sensor configured to detect a presence of the blockage outside of the flow of the liquid through the heat exchanger.

In another embodiment, a defrostable heat exchanging apparatus is provided that includes a heat exchanger configured to cool gas flowing therethrough by heating a liquid also passing therethrough. In this regard, the heat exchanger is configured such that the liquid passes from a first side to a second side of the heat exchanger. The defrostable heat exchanging apparatus of this embodiment also includes a blockage positionable upstream of the first side of the heat exchanger with respect to the liquid so as to reduce flow of the liquid through a portion of the heat exchanger aligned with the blockage relative to the flow of the liquid through other portions of the heat exchanger. The blockage is smaller than the first side of the heat exchanger so as to only block a portion of the heat exchanger. The defrostable heat exchanging apparatus of this embodiment also includes a positioning mechanism configured to move the blockage relative to the heat exchanger, such as in response to the flow of liquid.

The positioning mechanism of one embodiment may include a chain and a plurality of sprockets about which the chain extends with the blockage being engaged by and moving with the chain. The positioning mechanism may also include at least one of a Pelton wheel or a water wheel operably connected to a respective sprocket. In one embodiment, the blockage is positionable outside of the flow of the liquid through the heat exchanger. As such, the defrostable heat exchanging apparatus may include a blockage sensor configured to detect a presence of the blockage outside of the flow of the liquid through the heat exchanger.

In a further embodiment, a method of defrosting a heat exchanger is provided that allows gas to flow through the heat exchanger, allows liquid to also pass through the heat exchanger so as to cool the gas and positions a blockage upstream of the heat exchanger with respect to the liquid so as to reduce the flow of the liquid through a portion of the heat exchanger aligned with the blockage relative to the flow of the liquid through other portions of the heat exchanger. The method also moves the blockage relative to the heat exchanger.

The blockage may be moved by actuating movement of the blockage by the flow of liquid. In this regard, the blockage may be moved by controlling the flow of liquid so as to controllably move the blockage. For example a portion of the flow of liquid may be controllably diverted so as to controllably move the blockage. The method of one embodiment may also include positioning the blockage outside of the flow of the liquid through the heat exchanger. As such, the method may move the blockage from a position outside of the flow of liquid through the heat exchanger across a width of the heat exchanger.

In accordance with embodiments of the present disclosure, a defrostable heat exchanging apparatus and an associated method are provided in order to permit a heat exchanger to be defrosted without being taken out of service, thereby allowing the heat exchanger to continue to exchange heat between a gas and a liquid while defrosting a portion of the heat exchanger. However, the features, functions and advantages that have been discussed may be achieved independently and the various embodiments of the present disclosure may be combined in other embodiments, further details of which may be seen with reference to the detailed description and drawings.

BRIEF DESCRIPTION OF THE SEVERAL VIEWS OF THE DRAWINGS

Figure 1:
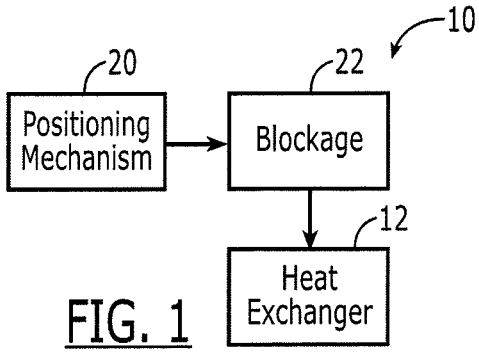
Figure 2:
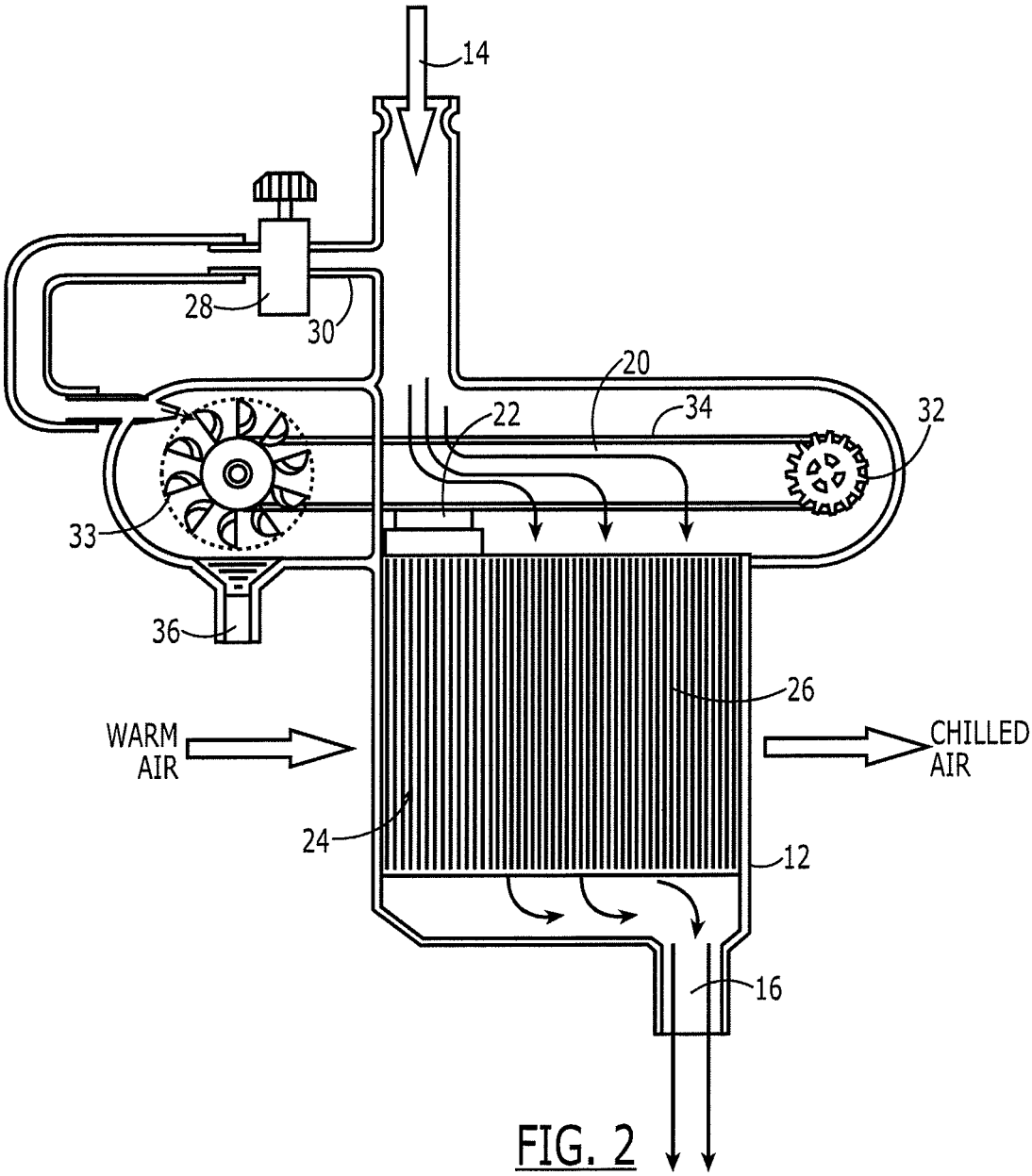
Figure 3:
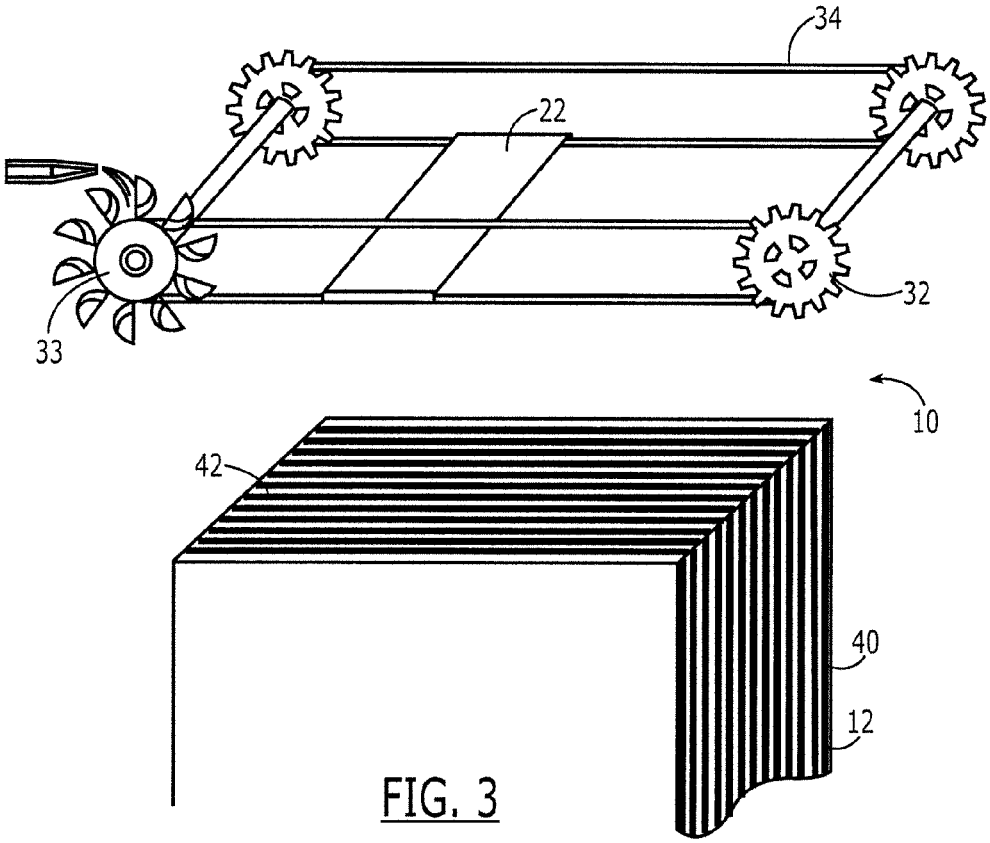
Figure 4:
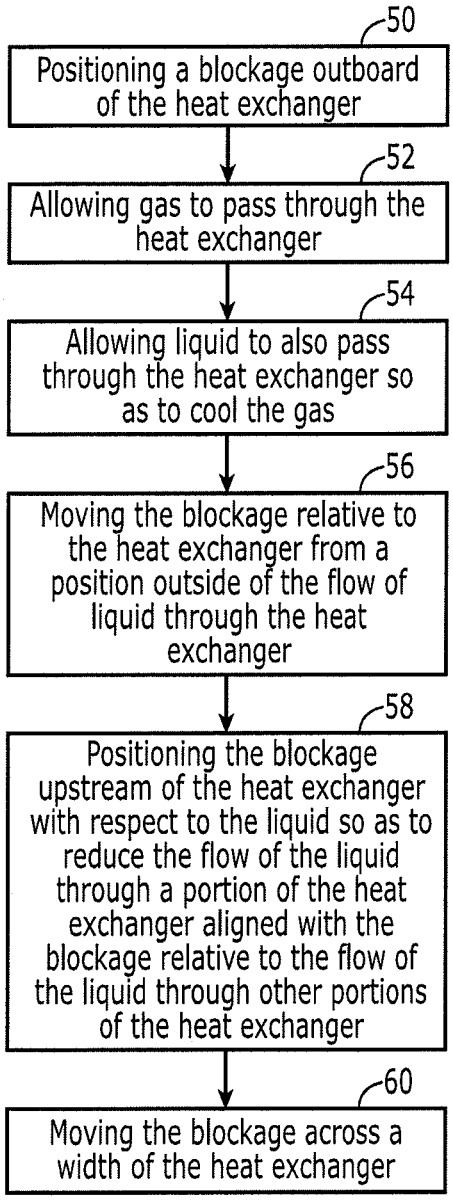
Figure 5:
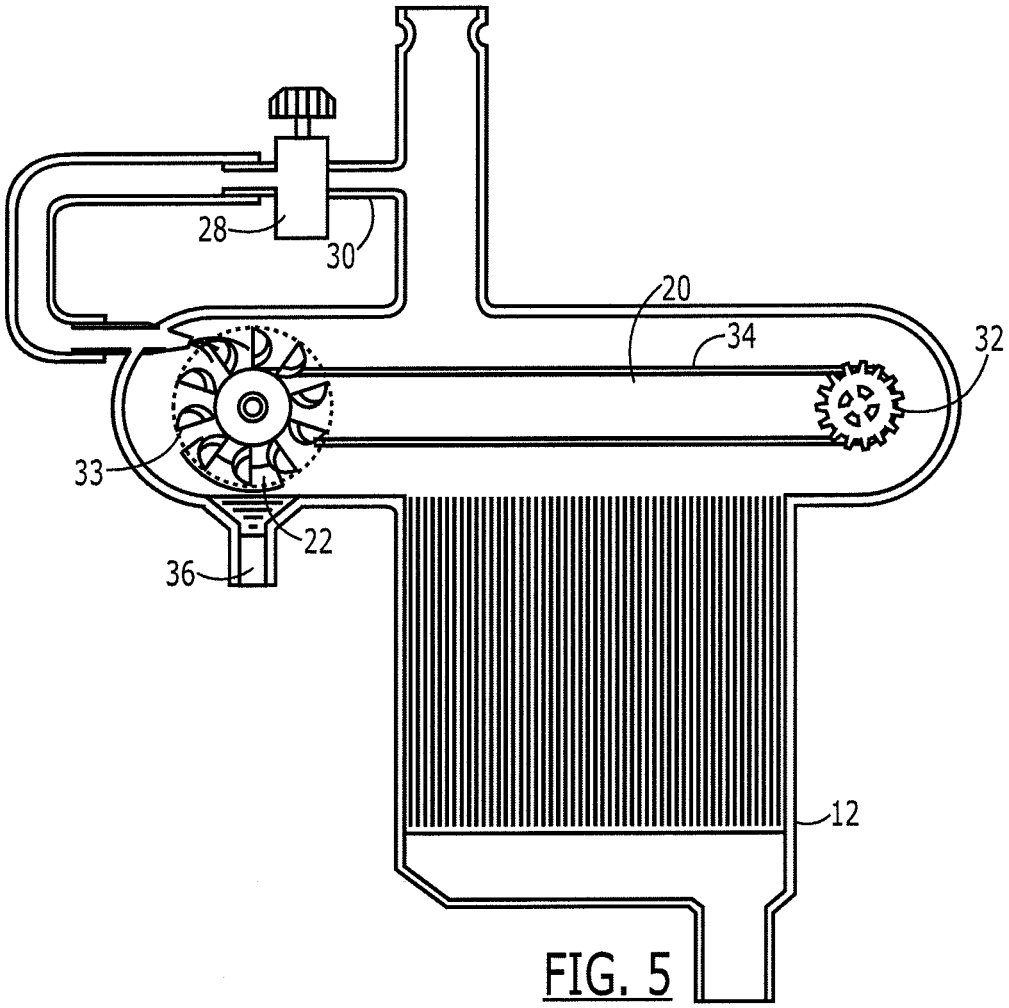
Figure 6:
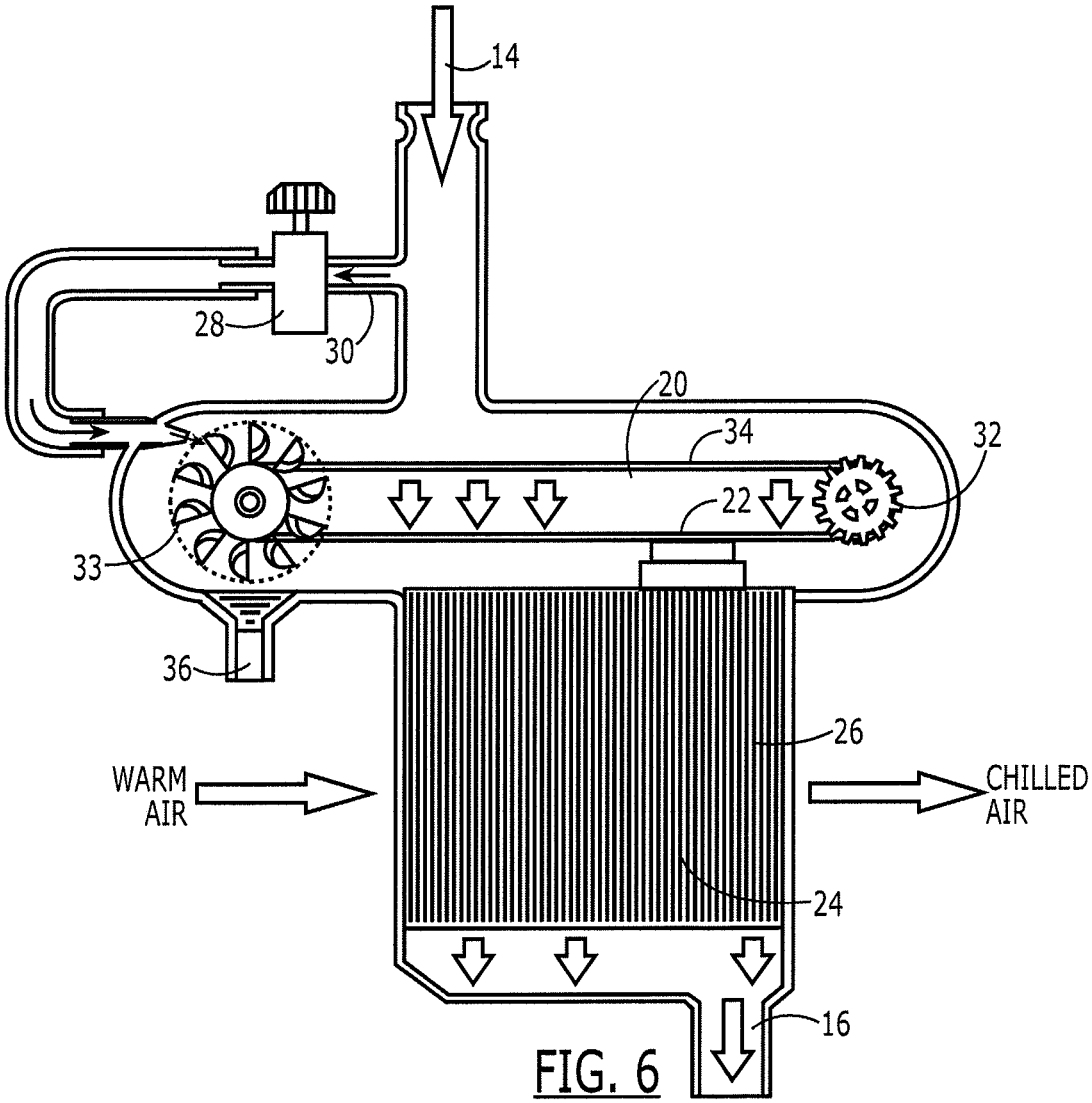

Having thus described embodiments of the present disclosure in general terms, reference will now be made to the accompanying drawings, which are not necessarily drawn to scale, and wherein:

FIG. 1 is a block diagram of a defrostable heat exchanging apparatus in accordance with one embodiment of the present disclosure;

FIG. 2 is a schematic representation of a defrostable heat exchanging apparatus in accordance with one embodiment of the present disclosure with the blockage in a first position relative to the heat exchanger;

FIG. 3 is a perspective view of a portion of the defrostable heat exchanging apparatus of FIG. 2 in accordance with an embodiment of the present disclosure;

FIG. 4 is a flowchart illustrating operations performed in accordance with one embodiment of the present disclosure;

FIG. 5 is a schematic representation of a defrostable heat exchanging apparatus in accordance with one embodiment of the present disclosure with the blockage being positioned outside of the flow of liquid; and FIG. 6 is a schematic representation of a defrostable heat exchanging apparatus in accordance with one embodiment of the present disclosure with the blockage in a second position relative to the heat exchanger.

DETAILED DESCRIPTION

Embodiments of the present disclosure now will be described more fully hereinafter with reference to the accompanying drawings, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, a block diagram of a heat exchanging apparatus 10 in accordance with one embodiment of the present disclosure is depicted. The heat exchanging apparatus 10 is configured to exchange heat between a liquid and a gas, such as air. In this regard, the heat exchanging apparatus 10 includes a heat exchanger 12. As shown in more detail in the embodiment of FIG. 2, warm gas enters one side of the heat exchanger 12 such as the left side of the illustrated embodiment, flows through the heat exchanger and then exits from another side of the heat exchanger, such as the right side in the embodiment of FIG. 2. As shown in FIG. 3, the heat exchanger 12 includes a plurality of first channels 40 through which the gas flows that extend from the side at which the warm gas enters the heat exchanger 12 to the side at which the gas exits the heat exchanger. The heat exchanger 12 also receives a cool liquid through an inlet 14 which enters, for example, via a different side of the heat exchanger, such as the top side as shown in the embodiment of FIG. 2. In this regard, the cool liquid has a lower temperature than the temperature of the gas so as to absorb heat therefrom. The liquid also passes through the heat exchanger 12 and exits through an outlet 16 at another side of the heat exchanger, such as the bottom side of the heat exchanger shown in the embodiment of FIG. 2. As such, the heat exchanger 12 also includes a plurality of second channels 42 extending from the side at which the liquid enters the heat exchanger to the side at which the liquid exits the heat exchanger, as shown in FIG. 3.

Within the heat exchanger 10, the gas and the liquid are physically separated from one another but are in thermal communication with one another. As such, heat may be transferred therebetween. In one embodiment in which warm gas and cool liquid are provided to the heat exchanger 10, heat may be transferred from the warm gas to the cold liquid such that chilled gas exits the heat exchanger as well as warmer liquid. In this regard, the temperature of the liquid is less than the temperature of the gas and, more particularly, the temperature of the warmer liquid that exits the heat exchanger 12 is generally lower than the temperature of the chilled gas that exits the heat exchanger. In order to facilitate the heat exchange, the plurality of first and second channels 40, 42 may be positioned in an alternating relationship such that a first channel through which gas flows is positioned between a pair of second channels through which liquid passes. Similarly, a second channel 42 through which liquid passes is positioned between a pair of first channels 40 through which gas flows. A common wall may separate adjacent channels, such as by separating a first channel 40 through which gas flows from a second channel 42 through which liquid passes. By forming the channel walls of the heat exchanger 10 from a thermally conductive material, such as an aluminum alloy, a steel alloy, a super alloy, e.g., an Inconel® alloy, a thermoplastic, e.g. polyetheretherketone (PEEK), or the like, heat may be transferred between the gas and the liquid through the channel walls.

In order to further facilitate the transfer of heat therebetween, the heat exchanger 12 may include a plurality of fins extending into the respective channels from the walls that define the channels. In this regard, a plurality of fins may extend from the walls into the first channels 40 through which the gas flows, thereby further facilitating the heat exchange between the gas and the liquid.

In order to substantially cool the warm gas, a liquid may at least sometimes be provided to the heat exchanger 10 that is at a temperature below the freezing temperature of water. As such, water that condenses from the warm, humid gas may freeze within the heat exchanger 12 and, more particularly, within the first channels 40 through which the gas flows. As such, the heat exchanging apparatus 10 provides a mechanism for defrosting the heat exchanger 12, thereby melting any liquid that freezes within the heat exchanger. However, the heat exchanging apparatus 10 continues to permit gas and liquid to be provided to the heat exchanger 12 and does not require the heat exchanger to be taken out of service.

In this regard, the heat exchanging apparatus 10 may include a positioning mechanism 20 that, in turn, includes or controls a blockage 22, as shown schematically in FIG. 1. The blockage 22 is positioned upstream of the heat exchanger 12 with respect to the flow of the liquid, as shown in FIGS. 2 and 3. In one embodiment, the blockage 22 is positioned proximate the side of the heat exchanger 12 that receives the cool liquid. The blockage 22 does not extend across the entire side of the heat exchanger 12 and, instead, only covers or blocks a portion of the side that receives the cool liquid. The blockage 22 may be formed of various materials, such as any of the materials described above in conjunction with the walls of the heat exchanger. The blockage 22 may be formed of a solid material so as to prevent or at least limit the flow of liquid through the second channels 42 that are aligned with and blocked by the blockage. Alternatively, the blockage 22 may be porous, such as by including a plurality of openings or being formed of a porous material, for discouraging, but not preventing, flow of the liquid through the second channels 42 that are aligned with and blocked by the blockage. In this regard, the blockage 22 may be perforated or may be a screen. Regardless of whether the blockage 22 is solid or is porous, the blockage in the embodiment of FIG. 1 is aligned with a subset 24 of the second channels 42, thereby preventing or at least limiting the flow of liquid through the second channels aligned with the blockage. However, the liquid may continue to flow through the remainder 26 of the second channels 42. In one embodiment as shown in FIG. 1, the blockage 22 has a width that is less than 50% of the width of the first side of the heat exchanger 12 through which the liquid enters and, in one embodiment, is less than or equal to about 25% of the width of the first side of the heat exchanger. However, the blockage 22 may be larger or smaller in other embodiments.

By preventing or reducing the flow of liquid through the second channels 42 that are aligned with the blockage 22, the warm gas that enters the heat exchanger 12 serves to defrost the subset 24 of first channels 40 that are aligned with the blockage. In this regard, ice that has formed within the subset 24 of the first channels 40 through which gas flows that is aligned with the blockage 22 may be melted by the warm gas. As such, the amount of gas that may flow through the heat exchanger 12 may be increased by the defrosting of the portion of the heat exchanger aligned with the blockage 22. The blockage 22 may, in turn, be moved across the width of the heat exchanger 12 so as to permit other portions of the heat exchanger to be defrosted in the manner described below.

The blockage 22 may be positioned proximate the heat exchanger 12 and moved across its width in various manners. For example, the positioning mechanism 20 may be configured to cause the blockage 22 to be hydraulically actuated, such as by means of a Pelton wheel as described below in conjunction with the illustrated embodiment, a vaned pump, reciprocating pistion(s) or the like. Alternatively, the positioning mechanism 20 may be configured to cause the blockage 22 to be electrically actuated, such as by means of a stepper motor, an AC motor, a DC motor or the like. Still further, the positioning mechanism 20 may be configured to cause the blockage 22 to be pneumatically actuated. A positioning mechanism 20 configured to hydraulically actuate the blockage 22 utilizing, for example, a Pelton wheel, will now be described for purposes of example, but not of limitation.

In the embodiment shown in FIGS. 2 and 3, for example, the positioning mechanism 20 may include a plurality of sprockets 32 connected by respective shafts. In this regard, first and second pairs of sprockets 32 may be positioned on opposite sides of the heat exchanger 12 with each respective pair of sprockets connected by a shaft. As shown in FIGS. 2 and 3, the sprockets 32 are generally positioned outboard of the heat exchanger 12 such that the sprockets do not interrupt the flow of liquid to the heat exchanger. As also shown in FIGS. 2 and 3, the positioning mechanism of one embodiment also includes a pair of chains, belts or other conveying mechanisms (hereinafter generically referred to as "chains 34") that extend about a respective pair of sprockets (with the sprockets of each pair being positioned on opposite sides of the heat exchanger 12) so as to form an endless path of travel therearound. The chains 34 may also be positioned outboard of the heat exchanger 12 so as not to block the flow of liquid to the heat exchanger. However, the chains 34 of one embodiment may also or alternatively include a plurality of openings therethrough so facilitate the passage of liquid through the chains.

The blockage 22 of this embodiment is carried by the chains 34, such as by extending between the chains so as to be engaged by and connected to the chains, thereby moving with the chains as the sprockets 32 rotate. By controllably rotating the sprockets 32 and moving the chains 34, the blockage 22 may, in turn, be controllably moved relative to the heat exchanger 12, such as across the width of the heat exchanger. Although the motive force for moving the blockage 22 may be provided in various manners as noted above, the positioning mechanism 20 of one embodiment may be hydraulically actuated and, as such, may utilize liquid that enters the heat exchanger 12 to move the blockage in one embodiment. In the embodiment of FIGS. 2 and 3, the positioning mechanism 20 may also include a Pelton wheel 33 or water wheel operably connected to a respective sprocket 32, either directly, via one or more gears or otherwise. By controllably directing at least a portion of the liquid that is provided to the heat exchanger 12 to the Pelton wheel 33 or water wheel, the Pelton wheel or water wheel is rotated which, in turn, causes the sprocket 32 that is operably connected thereto to be rotated so as to move the chains 34 and the blockage 22 relative to the heat exchanger. As with the sprockets 32, the Pelton wheel 33 may be positioned outside of the primary flow of liquid to the heat exchanger 12, but is positioned so as to receive the liquid diverted through a side channel 30 as described below.

Although the liquid may be provided to the Pelton wheel 33 or water wheel in various manners, the heat exchanging apparatus 10 of the illustrated embodiment includes a control valve 28 for controlling the flow of liquid to the Pelton wheel or the water wheel. For example, a side channel 30 may be defined through which a portion of the liquid that is otherwise received by the heat exchanger 12 may be diverted. A control valve 28 may be positioned so as to controllably open or close the side channel 30. The control valve 28 may, in turn, be controlled by a control unit, such as a computing device, e.g., a computer, controller or the like. In instances in which the side channel 30 is opened, such as by opening the control valve 28, a portion of the liquid is diverted through the side channel and is delivered to the Pelton wheel 33 or water wheel, thereby causing the sprocket 32 that is operably connected to the Pelton wheel or water wheel to be rotated and, in turn, causing the chains 34 and the blockage 22 to be moved relative to the heat exchanger 12. Alternatively, the control valve 28 may cause the side channel 30 to be closed, thereby preventing the diversion of liquid through the side channel and preventing liquid from being delivered to the Pelton wheel 33 or water wheel. In this instance, the Pelton wheel 33 or water wheel is not rotated and the blockage 22, in turn, does not move and remains fixed in position relative to the heat exchanger 12.

Regardless of the type of motive force, the positioning mechanism 20 may controllably position the blockage 22 relative to the heat exchanger 12 so as to defrost different portions of the heat exchanger. The blockage 22 may also be controllably moved across the heat exchanger 12, such as at a predefined rate of travel, in order to permit different portions of the heat exchanger to be defrosted. Further, the blockage 22 may be positioned outboard of the heat exchanger 12 so as not to block any liquid that would otherwise enter the heat exchanger, thereby permitting the heat exchanger to operate at maximum cooling capacity in instances in which defrosting is not required.

Referring now to FIG. 4, the operations of a heat exchanging apparatus 10 and method in accordance with one embodiment of the present disclosure are illustrated. As shown in block 50, the blockage 22 may initially be positioned outboard of the heat exchanger 12. As shown in the embodiment of FIG. 5, for example, the blockage 22 may be positioned so as not to be aligned with any portion of the heat exchanger 12. In the embodiment of FIG. 5, the heat exchanging apparatus 10 may include a blockage sensor 36 for detecting the presence of the blockage 22 in a position outboard of the heat exchanger 12. Thus, in an instance in which the blockage 22 is to be positioned outboard of the heat exchanger 12 so as to permit the heat exchanger to operate at a maximum cooling capacity as a result of the passage of liquid through the entire heat exchanger 12, the blockage 22 may be advanced, such as by rotation of the sprockets 32 of the illustrated embodiment, until the blockage sensor 36 detects the blockage. The positioning mechanism 20 may then halt further movement of the blockage 22, at least temporarily, so as to park the blockage 22 outside of the flow of liquid through the heat exchanger 12. In the embodiment of FIG. 5, for example, the control valve 28 may be closed so as to cause the side channel 30 to be closed, thereby preventing diversion of fluid through the side channel. As such, the Pelton wheel 33 or water wheel is no longer rotated such that the blockage remains in the position outboard of the heat exchanger as shown in FIG. 5. As shown in blocks 52 and 54, gas may then be allowed to flow through the heat exchanger 12 and liquid may also be allowed to concurrently flow through the heat exchanger. In this regard, warm gas and a cool liquid may be provided to the heat exchanger 12 such that heat is exchanged therebetween in order to heat the liquid and chill the gas.

In order to defrost the heat exchanger 12, the positioning mechanism 20 may then cause the blockage 22 to be moved relative to the heat exchanger 12 from the position outside of the flow of liquid to a position overlying a portion of the heat exchanger, such as from the position shown in FIG. 5 to a position shown in FIG. 2. See operation 56. Although the positioning mechanism 20 may cause the blockage 22 to be moved in various manners, the positioning mechanism of one embodiment may cause the blockage 22 to be moved by causing the control valve 28 to be opened such that liquid is diverted through the side channels 30 so as to drive the Pelton wheel 33 or water wheel, thereby rotating the sprockets 32 and moving the blockage across the width of the heat exchanger 12. As shown in block 58, the blockage 22 may be positioned upstream of the heat exchanger 12 with respect to the liquid so as to reduce the flow of the liquid through a portion of the heat exchanger aligned with the blockage relative to the flow of the liquid through other portions of the heat exchanger. With respect to the embodiment shown in FIG. 3, the flow of liquid through the subset 24 of second channels 42 of the heat exchanger 12 that is aligned with the blockage 22 is reduced relative to the flow of liquid through other portions 26 of the heat exchanger. As such, the flow of the warm gas through the heat exchanger 12 serves to defrost that portion of the first channels 40 aligned with the blockage 22 since the cool liquid is no longer flowing therethrough, at least not in significant quantities. By defrosting that portion of the first channels 40 that is aligned with the blockage 22, the ice that has formed within that portion of the first channels by condensation from the warm gas is melted, thereby allowing a greater quantity of gas to flow therethrough. Thus, the cooling capacity of the heat exchanger 12 is maintained at a relatively high level.

As shown in block 60 of FIG. 4, the positioning mechanism 20 may cause the blockage 22 to be moved across the width of the heat exchanger 12. For example, FIG. 6 illustrates the movement of the blockage 22 to another position so as to be aligned with a different portion of the heat exchanger 12. As described above, the blockage 22 of one embodiment may be moved relative to the heat exchanger 12 by opening the control valve 28 and diverting liquid through the side channel 30. The diverted liquid of this embodiment drives the rotation of the Pelton wheel 33 or water wheel which, in turn, rotates the sprockets 32 and moves the chains 34 and the blockage 22 with respect to the heat exchanger 12.

The control valve 28 of the illustrated embodiment may be actuated, such as by the control unit, so as to control the amount of liquid diverted through the side channel 30. In one embodiment, the control valve 28 may open the side channel 30 to an extent that the diverted liquid continuously drives the Pelton wheel 33 or water wheel at a rate that causes the blockage 22 to move continuously across the width of the heat exchanger 12 at a predefined velocity. In this regard, the velocity may be defined in a manner that ensures that the flow of warm gas through that portion of the heat exchanger 12 that is aligned with the blockage 22 will defrost that portion of the heat exchanger.

In an alternative embodiment, the control valve 28 may control the diversion of the liquid through the side channel 30 and the driving of the Pelton wheel 33 or water wheel in such a manner that the blockage 22 is advanced in a stepwise manner across the width of the heat exchanger 12. In this embodiment, the blockage 22 is positioned in a first position, such as shown in FIG. 2 and the control valve 28 then closes the side channel 30 so as to prevent rotation of the Pelton wheel 33 or water wheel and to also prevent movement of the blockage. Warm gas flows through the heat exchanger 12 while the blockage 22 remains in this position so as to defrost that portion of the heat exchanger with which the blockage is aligned. Once that portion of the heat exchanger 12 has been defrosted or following a predefined period of time, the control valve 28 of this embodiment may be opened so as to divert liquid through the side channel 30 and to cause the Pelton wheel 33 or water wheel to rotate, thereby moving the blockage 22 to another position. Once the blockage 22 has been repositioned in this embodiment, the control valve 28 may be closed so as to again close the side channel 30 while the blockage remains in a second position and the portion of the heat exchanger 12 aligned with the second position of the blockage is defrosted. This process may be repeated in a stepwise manner until all portions of the heat exchanger 12 have been defrosted. For example, FIG. 6 illustrates the blockage 22 in another position subsequent to that shown in FIG. 2 with another portion of the heat exchanger 12, namely, that portion 24 aligned with the blockage, being defrosted by the flow of warm gas therethrough.

Once the blockage 22 has passed across the width of the heat exchanger 12 in accordance with the illustrated embodiment, the control valve 28 may remain open so as to divert a portion of the liquid through the side channel 30 in order to continuously drive the Pelton wheel 33 or water wheel such that the blockage 22 travels with the chain 34 about the sprockets 32 so as to return to a position outboard of the heat exchanger 12, such as shown in FIG. 5. Upon detection of the blockage 22 by the blockage sensor 36, the control valve 28 may close the side channel 30, thereby causing the blockage to remain in the position outboard of the heat exchanger 12 until further defrosting is required.

Defrosting of the heat exchanger 12 may be performed on a predefined schedule, such as a predefined schedule defined by the control unit which communicates with the positioning mechanism 20 which, in turn, directs the control valve 28 and responds to the blockage sensor 36 as described above. Alternatively, the heat exchanging apparatus 10 and method may include a pressure switch or a gas flow sensor for monitoring the quantity of chilled gas that exits the heat exchanger 12. As ice accumulates within the heat exchanger 12, such as within the first channels 40 through which the gas flows, the quantity of gas that exits the heat exchanger 12 may be reduced. As such, the gas flow sensor may provide information indicative of the quantity of chilled gas that exits the heat exchanger 12 to the control unit. The control unit may be configured to instruct the positioning mechanism 20 to open the control valve 28 and to cause the blockage 22 to be moved into a first position, such as shown in FIG. 2, aligned with a portion of the heat exchanger 12 in order to commence the defrosting operations once the information provided by the gas flow sensor indicates that the quantity of chilled gas that exits the heat exchanger has fallen below a predefined threshold that is indicative of the accumulation of ice within the heat exchanger.

As such, the heat exchanging apparatus 10 and method of one embodiment may controllably defrost the heat exchanger 12 while the heat exchanger continues to operate in order to cool gas flowing therethrough. Accordingly, the cooling capacity of the heat exchanger 12 may be maintained at a relatively high level while offering continuous service. Additionally, liquid having a temperature below the freezing temperature of water may be utilized in order to promote efficient heat-exchanging operations since any accumulation of ice may be readily defrosted without having to take the heat exchanging apparatus 10 offline.

Many modifications and other embodiments set forth herein will come to mind to one skilled in the art to which these embodiments pertain having the benefit of the teachings presented in the foregoing descriptions and the associated drawings. Therefore, it is to be understood that the embodiments are not to be limited to the specific ones disclosed and that modifications and other embodiments are intended to be included within the scope of the appended claims. For example, although one embodiment of a hydraulically actuated positioning mechanism 20 is described above, the positioning mechanism may alternatively be hydraulically actuated in other manners or may be actuated electrically, pneumatically or otherwise in other embodiments. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions other than those explicitly described above are also contemplated as may be set forth in some of the appended claims. Although specific terms are employed herein, they are used in a generic and descriptive sense only and not for purposes of limitation.

That which is claimed:

1. A defrostable heat exchanging apparatus comprising:

a heat exchanger configured to cool gas flowing there through by heating a liquid also passing there through;

a blockage having a predefined, fixed width and positionable upstream of the heat exchanger with respect to the liquid so as to reduce flow of the liquid through a portion of the heat exchanger aligned with the blockage relative to the flow of the liquid through other portions of the heat exchanger; and a positioning mechanism for moving the blockage of the predefined, fixed width relative to the heat exchanger in order to block a plurality of different portions of the heat exchanger while the entire predefined, fixed width of the blockage overlies different portions of the heat exchanger, wherein the positioning mechanism comprises a pair of conveying mechanisms spaced apart from one another and defining respective endless paths of travel, wherein the blockage is enraged by, extends between and moves with the pair of conveying mechanisms, wherein the positioning mechanism is configured to move the blockage relative to the heat exchanger so as to sequentially uncover each portion of the heat exchanger that is configured to receive liquid in order to permit liquid to flow therethrough while another portion of the heat exchanger that would also be configured to receive liquid in an absence of the blockage is blocked, and wherein the positioning mechanism is further configured to move the blockage relative to the heat exchanger such that uncovering of one portion of the heat exchanger occurs simultaneously with blocking of another portion of the heat exchanger, wherein the positioning mechanism is configured to be actuated by the flow of liquid so as to move the blockage relative to the heat exchanger, and wherein pair of conveying mechanisms comprise a pair of chains and a plurality of sprockets about which the chains extend, wherein the blockage is engaged by and moves with the chains.

2. A defrostable heat exchanging apparatus comprising:

a heat exchanger configured to cool gas flowing there through by heating a liquid also passing there through, wherein the heat exchanger is configured such that the liquid passes from a first side to a second side of the heat exchanger;

a blockage having a predefined, fixed width in a first direction and positionable in the first direction upstream of the first side of the heat exchanger with respect to the liquid so as to reduce flow of the liquid through a portion of the heat exchanger aligned with the blockage relative to the flow of the liquid through other portions of the heat exchanger, wherein the blockage is smaller than the first side of the heat exchanger and, in an instance in which the blockage is positioned relative to the heat exchanger such that the entire predefined, fixed width of the blockage overlies and is aligned with the portion of the heat exchanger, the blockage will only block the portion of the heat exchanger with the entire predefined, fixed width of the blockage while other portions of the heat exchanger remain unobstructed by the entire predefined, fixed width of the blockage; and a positioning mechanism configured to move the blockage of the predefined, fixed width relative to the heat exchanger, wherein the positioning mechanism comprises a pair of conveying mechanisms spaced apart from one another and defining respective endless paths of travel, wherein the blockage is engaged by, extends between and moves with the pair of chains, wherein the positioning mechanism is configured to move the blockage relative to the heat exchanger so as to sequentially uncover each portion of the heat exchanger that is configured to receive liquid in order to permit liquid to flow therethrough while another portion of the heat exchanger that would also be configured to receive liquid in an absence of the blockage is blocked, and wherein the positioning mechanism is further configured to move the blockage relative to the heat exchanger such that uncovering of one portion of the heat exchanger occurs simultaneously with blocking of another portion of the heat exchanger, wherein the positioning mechanism is responsive to the flow of liquid for moving the blockage relative to the heat exchanger, and wherein the pair of conveying mechanisms comprise a pair of chains and a plurality of sprockets about which the chains extend, wherein the blockage is engaged by and moves with the chains.

3. A method of defrosting a heat exchanger comprising: allowing gas to flow through the heat exchanger; allowing liquid to also pass through the heat exchanger so as to cool the gas; positioning a blockage having a predefined, fixed width upstream of the heat exchanger with respect to the liquid so as to reduce the flow of the liquid through a portion of the heat exchanger aligned with the blockage relative to the flow of the liquid through other portions of the heat exchanger; and moving the blockage of the predefined, fixed width relative to the heat exchanger in order to block a plurality of different portions of the heat exchanger while the entire predefined, fixed width of the blockage overlies the plurality of different portions of the heat exchanger, wherein moving the blockage comprises moving the blockage with a pair of conveying mechanisms spaced apart from one another and defining respective endless paths of travel as a result of the blockage engaging and extending between the pair of conveying mechanisms, wherein moving the blockage comprises moving the blockage relative to the heat exchanger so as to sequentially uncover each portion of the heat exchanger that is configured to receive liquid in order to permit liquid to flow therethrough while another portion of the heat exchanger that would also be configured to receive liquid in an absence of the blockage is blocked, and wherein moving the blockage relative to the heat exchanger is such that uncovering of one portion of the heat exchanger occurs simultaneously with blocking of another portion of the heat exchanger, wherein the positioning mechanism is actuated by the flow of liquid so as to move the blockage relative to the heat exchanger, and wherein the pair of conveying mechanisms comprise a pair of chains and a plurality of sprockets about which the chains extend, wherein the blockage is engaged by and moves with the chains.

4. The defrostable heat exchanging apparatus according to claim 1 wherein the heat exchanger is configured such that the liquid flows from a first side to a second side of the heat exchanger, wherein the blockage is smaller than the first side of the heat exchanger so as to only block the portion of the heat exchanger.

5. The defrostable heat exchanging apparatus according to claim 1 wherein the positioning mechanism further comprises at least one of a Pelton wheel or a water wheel operably connected to a respective sprocket.

6. The defrostable heat exchanging apparatus according to claim 5 further comprising a control valve configured to control the flow of liquid to the at least one of the Pelton wheel or the water wheel in order to controllably move the chain and position the blockage.

7. The defrostable heat exchanging apparatus according to claim 1 wherein the blockage is positionable outside of the flow of the liquid through the heat exchanger.

8. The defrostable heat exchanging apparatus according to claim 7 further comprising a blockage sensor configured to detect a presence of the blockage outside of the flow of the liquid through the heat exchanger.

9. The defrostable heat exchanging apparatus according to claim 1 wherein the blockage defines a plurality of openings.

10. The defrostable heat exchanging apparatus according to claim 1 further comprising a sensor configured to monitor gas flow through the heat exchanger, wherein the positioning mechanism is responsive to the sensor such that movement of the blockage is commenced in response to the gas flow through the heat exchanger monitored by the sensor.

11. The defrostable heat exchanging apparatus according to claim 2 wherein the positioning mechanism further comprises at least one of a Pelton wheel or a water wheel operably connected to a respective sprocket.

12. The defrostable heat exchanging apparatus according to claim 2 wherein the blockage is positionable outside of the flow of the liquid through the heat exchanger.

13. The defrostable heat exchanging apparatus according to claim 12 further comprising a blockage sensor configured to detect a presence of the blockage outside of the flow of the liquid through the heat exchanger.

14. The method according to claim 3 wherein moving the blockage comprises actuating movement of the blockage by the flow of liquid.

15. The method according to claim 14 wherein moving the blockage further comprises controlling the flow of liquid so as to controllably move the blockage.

16. The method according to claim 15 wherein controlling the flow of liquid comprises controllably diverting a portion of the flow of liquid so as to controllably move the blockage.

17. The method according to claim 3 further comprising positioning the blockage outside of the flow of the liquid through the heat exchanger.

18. The method according to claim 17 further comprising moving the blockage from a position outside of the flow of liquid through the heat exchanger across a width of the heat exchanger.

19. The method according to claim 3 further comprising providing liquid at a temperature below a freezing temperature of water prior to passage through the heat exchanger.

* * * * *